US006427693B1

(12) United States Patent
Blackstock et al.

(10) Patent No.: US 6,427,693 B1
(45) Date of Patent: Aug. 6, 2002

(54) FACE MASK STRUCTURE

(75) Inventors: Cindy J. Blackstock, Cumming, GA (US); Fred Hart, Keller; Lupe Santoy, Richland Hills, both of TX (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/563,439

(22) Filed: May 1, 2000

(51) Int. Cl.[7] ..... A62B 7/10

(52) U.S. Cl. ..... 128/205.27; 128/205.29; 128/206.19

(58) Field of Search ..... 128/205.27, 205.28, 128/205.29, 206.13, 206.19, 206.25

(56) References Cited

U.S. PATENT DOCUMENTS

| | | | | |
|---|---|---|---|---|
| 3,603,315 A | * | 9/1971 | Becker, III | 128/206.19 |
| 3,620,214 A | | 11/1971 | Thackston et al. | |
| 3,664,335 A | | 5/1972 | Boucher et al. | |
| 3,699,958 A | | 10/1972 | Szucs | |
| 3,779,244 A | | 12/1973 | Weeks, Jr. et al. | |
| 3,802,429 A | | 4/1974 | Bird | |
| 4,319,567 A | | 3/1982 | Magidson | |
| 4,355,637 A | * | 10/1982 | Dyer | 128/205.27 |
| 4,382,440 A | * | 5/1983 | Kapp et al. | 128/205.28 |
| 4,384,577 A | | 5/1983 | Huber et al. | |
| 4,454,881 A | | 6/1984 | Huber et al. | |
| 4,508,113 A | | 4/1985 | Malaney | |
| 4,536,440 A | | 8/1985 | Berg | |
| 4,628,927 A | | 12/1986 | Ward | |
| 4,635,628 A | | 1/1987 | Hubbard et al. | |
| 4,662,005 A | | 5/1987 | Grier- Idris | |
| 4,807,619 A | | 2/1989 | Dyrud et al. | |
| 4,827,924 A | | 5/1989 | Japuntich | |
| 4,850,347 A | | 7/1989 | Skov | |
| 4,856,509 A | | 8/1989 | Lemelson | |
| 4,873,972 A | | 10/1989 | Magidson et al. | |
| 4,883,052 A | * | 11/1989 | Weiss et al. | 128/205.27 |
| 4,883,547 A | | 11/1989 | Japuntich | |
| 5,094,236 A | | 3/1992 | Tayeri | |
| 5,269,294 A | * | 12/1993 | Rogozinski | 128/205.27 |
| 5,320,096 A | * | 6/1994 | Hans | 128/205.27 |
| 5,374,458 A | | 12/1994 | Burgio | |
| 5,400,780 A | * | 3/1995 | Nishino | 128/205.27 |
| 5,467,765 A | | 11/1995 | Maturaporn | |
| 5,620,545 A | | 4/1997 | Braun et al. | |
| 5,641,555 A | | 6/1997 | Berrigan et al. | |
| 5,643,507 A | | 7/1997 | Berrigan et al. | |
| 5,656,368 A | | 8/1997 | Braun et al. | |
| 5,658,641 A | | 8/1997 | Berrigan et al. | |
| 5,681,646 A | | 10/1997 | Ofosu et al. | |
| 5,688,157 A | | 11/1997 | Bradley et al. | |
| 5,706,803 A | | 1/1998 | Bayer | |
| 5,706,804 A | | 1/1998 | Baumann et al. | |
| 5,735,270 A | | 4/1998 | Bayer | |
| 5,763,078 A | | 6/1998 | Braun et al. | |
| 5,804,295 A | | 9/1998 | Braun et al. | |
| 5,955,193 A | | 9/1999 | Braun et al. | |
| 5,961,778 A | | 10/1999 | Braun et al. | |
| 6,010,766 A | | 1/2000 | Braun et al. | |

FOREIGN PATENT DOCUMENTS

| | | |
|---|---|---|
| GB | 850712 | 10/1960 |
| WO | 9204940 | 4/1992 |
| WO | 9853896 | 12/1998 |

OTHER PUBLICATIONS

PCT International Search Report, Dec. 6, 2001.

* cited by examiner

*Primary Examiner*—Aaron J. Lewis
(74) *Attorney, Agent, or Firm*—Dority & Manning

(57) ABSTRACT

An improved multi-layer face mask has at least one adhesive strip applied between the inner face cover layer and the intermediate filter layer. The adhesive strip is defined so as to extend across the filter body and is bounded on each longitudinal side by longitudinally extending regions that are free of adhesive. The adhesive strip may be disposed along a pleat formed in the face mask body. For example, the adhesive strip may have a width so as to extend between parallel fold lines of a pleat.

21 Claims, 2 Drawing Sheets

FIG. 1
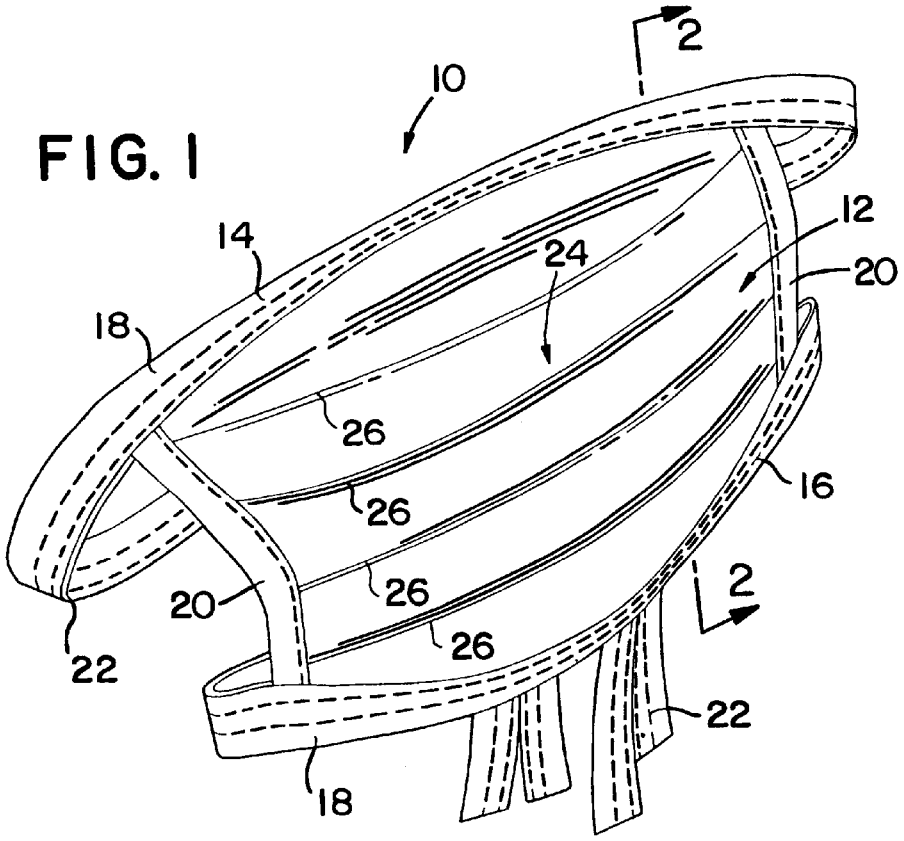
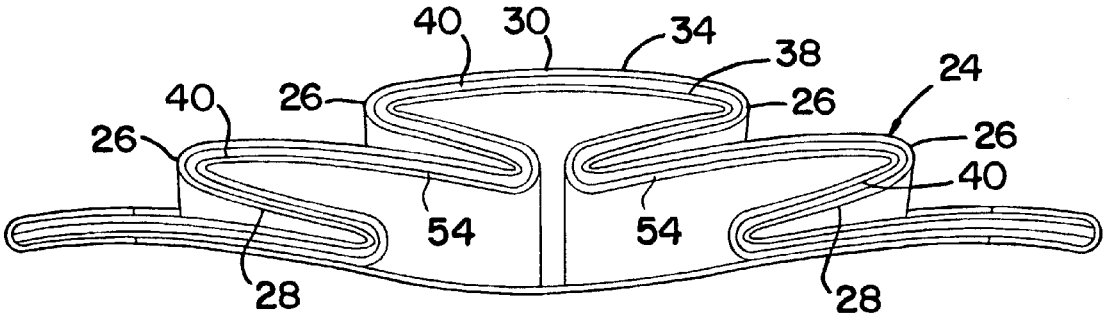
FIG. 2

FACE MASK STRUCTURE

BACKGROUND

The present invention relates to face masks in general, and particularly to an improved multi-layer face mask.

Multi-layer face masks are well known in the art. These face masks typically have a pleated configuration and contain at least one intermediate filtering layer disposed between an outside cover layer and an inner face cover layer. The cover layers, particularly the inner face layer, are generally formed of relatively lightweight and highly porous non-woven fabrics. The cover layers serve to retain the intermediate filtration layer or layers and also to provide a comfortable surface against the user's face. A suitable face cover layer material may be a carded non-woven fabric bonded with a thermoplastic binder or adhesive.

Due to the relatively light weight of the individual layers of the mask, particularly the cover layers, the layers are typically bonded together so that they may be pleated and a seam binding applied in an automated production line. Additionally, the face cover layer is typically separately bonded to the filtration layer at certain points to prevent it from moving over the nose or mouth of the wearer as the wearer inhales. If the face cover layer is not bonded, it tends to move against the nose or mouth of the wearer and, although this does not reduce the efficiency of the mask, causes discomfort to the wearer.

The bonding of the face cover layer to the filtration layer has been carried out in various ways. For example, the bonding may be done by heat sealing the layers together with sufficient force to effectuate the bond through all layers of the mask. The filtration medium filaments are typically thermoplastic, and the application of heat and pressure causes the filaments to melt and, upon cooling, harden and form a permanent bond between the three layers of the mask. It is also known to employ hot melt adhesives, or other types of adhesive materials, to effectuate a spot bonding of the layers of the mask together. U.S. Pat. No. 3,802,429 teaches that six to nine bonded areas located between the folds of the mask are sufficient to bond the three layers of the mask into a unitary laminate. Each bonded area is approximately ⅛ inch square and tends to be impervious to the passage of air through the mask.

Commercial examples of pleated masks having "spot" bonded areas are known in the art. The 1818 mask from 3M Corporation has an adhesive applied in a regular repeating "tracks" pattern over the entire surface of the three layer mask. The pattern can be seen on the outer cover layer of the mask since the adhesive is pigmented and causes a discoloration of the materials. Another commercial mask is the SoftTouch II mask formerly from Tecnol Medical Products. In this mask, the inner face layer is adhered to the filtration layer in a process wherein an adhesive is lightly sprayed over a center surface area strip between the filtration layer and the inner face layer.

A drawback with the present mask constructions is that adhesive bleed-through can be detrimental to the manufacturing process as a result of build-up on the equipment. Adhesive build-up on the production line surfaces makes collating and pleating of the layers extremely difficult and may cause shutdown of the equipment and production line. This problem is particularly acute when the adhesive is applied in a pattern or spray over the entire surface of the mask. An even more significant drawback is that the adhesive application is generally insufficient to keep the inner face layer attached to the filtration layer in all uses of the masks.

The present invention provides an improved mask while addressing the shortcomings of the conventional masks and production methods noted above.

OBJECTS AND SUMMARY

Objects and advantages of the invention will be set forth in part in the following description, or may be obvious from the description, or may be learned through practice of the invention.

In accordance with the invention, an improved multi-layer face mask is provided. The face mask includes a filter body having at least an outer cover layer, an inner face cover layer, and at least one intermediate layer, such as a filter layer, sandwiched between the face cover layer and outer cover layer. The filter body has at least one pleat formed therein that extends across the filter body. For example, the filter body may be defined by top and bottom edges, and side edges that extend between the top and bottom edges. The pleat extends longitudinally across the filter body between the side edges and is defined by generally parallel fold lines formed in the filter body layers. It should, however, be appreciated that the construction of the filter body and configuration of the pleats or fold lines is not particularly important to the present invention. Various styles of pleated face masks are known in the art and any such style is applicable to the present invention. For example, the pleats may be formed so as to open or unfold in one direction. In an alternative embodiment, oppositely facing pleats may be disposed on opposite sides of a center pleated panel. This configuration is well known from the 3M 1818 mask and the Tecnol Medical Products SoftTouch II mask.

It should also be appreciated that the particular types of materials used to form the layers of the face mask are not critical to the invention. Various types and combinations of materials are well known to those skilled in the art and any suitable materials or laminates may be used in a face mask in accordance with the present invention.

An adhesive is applied between the intermediate layer and the face layer in the manufacturing process of the mask prior to forming the pleat or pleats in the mask. The adhesive is applied along a plurality of longitudinal strips or sections across the filter body. For example, the strips may extend from one side edge of the mask to the other side edge of the mask. The adhesive strips are defined by longitudinal edges and may be applied in various ways. For example, the adhesive may be applied in a continuous application process wherein the adhesive is continuous or "unbroken" along the longitudinal section or strip. For example, the adhesive may be coated or sprayed continuously along the strip. Coverage of the adhesive between the edges of the longitudinal strip may be total or less than total. For example, a swirl coating process would apply the adhesive continuously along the strip, but surface area coverage of the adhesive between the edges of the strip would be less than total. In an alternative embodiment, the adhesive may be applied in a discontinuous process, such a pattern spray or discontinuous coating process, such that the adhesive is applied in discrete subsections or patterns along the strip.

So as to further minimize the potential for adhesive bleed through in the manufacturing process, it may be desired to dispose the adhesive strip along a pleat formed in the face mask. In this embodiment, the adhesive strip may have a width so as to extend at least between the fold lines of the pleat. Alternatively, the adhesive strip may extend beyond each of the fold lines a distance about equal to the overlap width of the subsequently formed pleat. It may be desired to provide such an adhesive strip for each pleat formed in the face mask.

A method for manufacturing an improved multi-layer face mask is also provided. The method includes applying an adhesive between the intermediate layer and the face cover layer of the mask along longitudinal strips or sections across the layers. This longitudinal strips are disposed between defined longitudinal lines or edges in varying degrees of coverage or patterns. For example, the adhesive may be sprayed along the strip in a continuous process for relatively complete or total coverage. In an alternative embodiment, the adhesive may be sprayed or coated in a pattern between the longitudinal edges.

Once the longitudinal adhesive strips are applied and the face layer and intermediate layer are bonded, a pleat is formed in the layers along at least one of the adhesive strips. The pleat is formed by parallel fold lines and the adhesive strip may be applied with a width so as to extend at least between the fold lines. The strip may extend beyond the fold lines a distance generally equal to the overlap width of the pleat.

By applying the adhesive in a generally longitudinal strip across the mask, particularly at the location of the pleats, it is ensured that the bond between the intermediate layer and the face layer is sufficient for all anticipated uses of the mask, and the potential for adhesive bleed through during the manufacturing process is significantly reduced by minimizing contact with the manufacturing equipment.

The invention will be described below in greater detail with reference to the figures.

BRIEF DESCRIPTION OF THE DRAWINGS

FIG. 1 is a perspective view of a face mask according to the present invention;

FIG. 2 is a cross-sectional perspective view of the face mask of FIG. 1 taken along the lines indicated.

DETAILED DESCRIPTION

Figure 3:
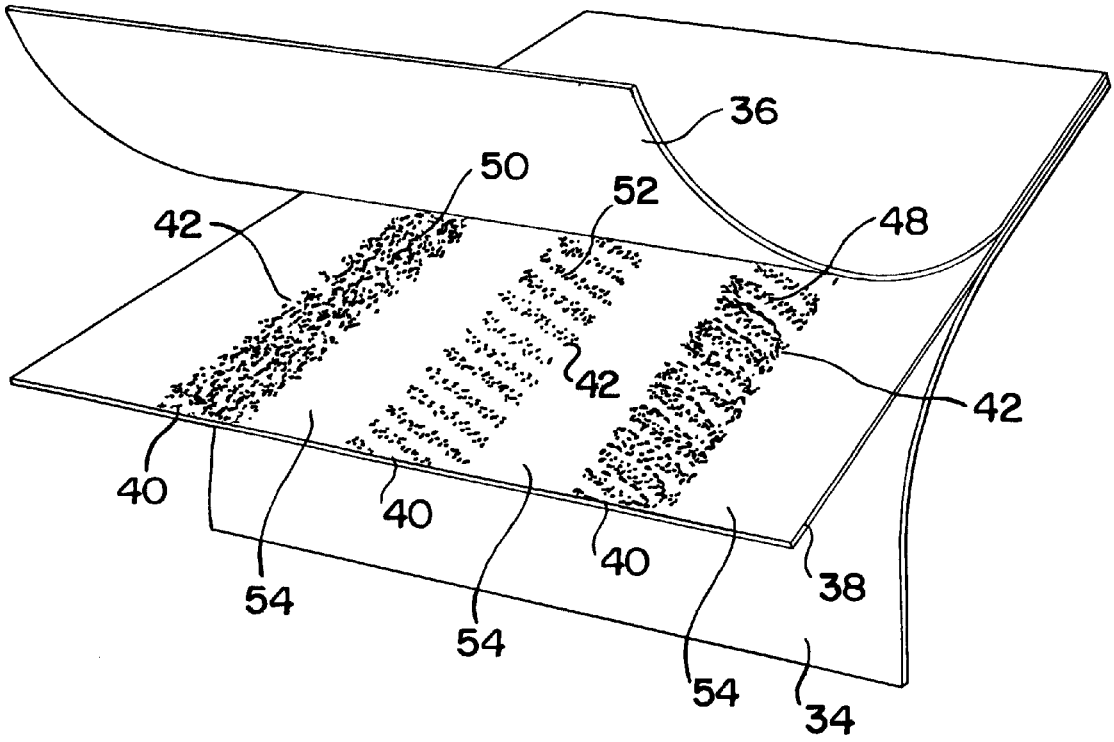
FIG. 3 is a view of the layers and various adhesive patterns for the face mask filter body.

Reference will now be made in detail to particular embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

The present invention relates to an improved multi-layered face mask. Various styles and configurations of multi-layered face masks are well known by those skilled in the art and the present invention is not limited to any particular style or configuration of such multi-layered face masks. The construction of face mask 10 illustrated in FIGS. 1 and 2 relates to a commercially available center panel pleated face mask. A face mask of this type is commercially available from 3M Corporation and is identified as the "1818" mask. Likewise, a similar face mask has been offered by the former Tecnol Medical Products, Inc. (now Kimberly Clark Corp.) known as the SoftTouch II face mask. These masks typically have one or more pleats 24 formed transversely across the filter body 12. In the embodiment illustrated in the figures, the pleat configuration consists of a center panel pleat 30 having at least one additional pleat 24 on each side of the center panel 30. The side pleats 24 open in opposite directions on each side of center panel 30. Various configurations wherein in a plurality of pleats open in the same direction across the filter body are also well known in the art, and the present invention is just as applicable to such pleated face masks.

The pleats 24 are generally defined between parallel fold lines 26 such that a panel 28 is disposed between the fold lines. This panel 28 defines an overlap width of the pleat, as illustrated in FIG. 2. The construction and formation of the pleats is not a critical aspect of the present invention and need not be described in great detail herein.

The face mask 10 has an outer cover layer 34, an inner face cover layer 36, and at least one intermediate layer 38. The intermediate layer 38 is generally a filter layer and may be, for example, a meltblown polypropylene layer, a spunbond fabric, or any other woven or nonwoven material having desirable combinations of relatively low air resistance and filtering efficiency. Various filtering media are known in the art for incorporation as a filter layer in a face mask, and all such materials are within the scope and spirit of the present invention.

The outer cover layers 34, 36 may be formed of any suitable material known in the art. For example, cover layers are known for providing liquid and gas permeability while providing the mask with structural integrity. Such layers may be a nonwoven web comprising thermoplastic staple fibers, or a nonwoven web formed of substantially continuous spunbond filaments. Various thermoplastic polymers may be used to form the cover layers, including polyolifins, polyesters, polyamides, and blends and copolymers of these and other known fiber forming thermoplastic materials. The inner layer 36 may also include cellulosic fibers, such as wood pulp, rayon, cotton, and the like. In one embodiment of the invention, the inner layer 36 is a carded rayon web. It should be appreciated that the present invention is not limited to any particular type of material, or combination of materials, with respect to the layers of the face mask.

The embodiment of a mask 10 according to the invention illustrated in FIG. 1 includes a top edge 14, a bottom edge 16, and side edges 20 that generally define the border of filter body 12. The top and side edges are sealed with a binding material 18. In the embodiment illustrated, the top and bottom edge binding material 18 also extends transversely from the filter body 12 to define tie straps 22. The binding material 18 may be thermally bonded to the filter body layers, or bonded in any other conventional manner, including adhesives, ultrasonic welds, etc. Such methods are well known to those skilled in the art.

Mask 10 according to the invention also includes an adhesive applied between outer layer 34 and intermediate filter layer 38. Referring to FIG. 2 in particular, this adhesive (shown as the thicker lines) is applied along defined longitudinal strips 40 between the inner face layer 36 and intermediate layer 38. The adhesive strips 40 are bordered on each longitudinal side 42 by longitudinally extending regions or strips 54 that are "adhesive-free". The relationship between the adhesive longitudinal strips 40 and adhesive-free longitudinal strips 54 can be particularly seen in FIG. 3.

The adhesive can be applied to the intermediate filter layer 38 or to the back side of the inner face layer 36 prior to forming pleats in the collated layers. FIG. 3 illustrates adhesive longitudinal strips 40 applied to the intermediate layer 38.

Any suitable adhesive may be used. In one embodiment, the adhesive is applied as a hot melt adhesive along the longitudinal adhesive strips 40. The adhesive may be applied in any conventional process, including a coating process, a swirl spray process, a meltblown spray process, etc. Any conventional adhesive applying process may be utilized. FIG. 3 illustrates various application patterns for the adhesive. The left hand adhesive strip 40 illustrates the adhesive applied from a continuous spray or coating process wherein coverage between the longitudinal edges 42 is generally total. The right hand longitudinal strip 40 illustrates adhesive applied by a continuous swirl spray process. Coverage of the adhesive between the longitudinal edges 42 is less than total in this process, as can be seen in FIG. 3. In other words, unbonded sections or areas remain within the longitudinal edges defining the adhesive strip 40. The middle adhesive strip 40 illustrates adhesive applied in a pattern coating or spray process wherein the adhesive is "discontinuous" along the strip 40. The adhesive may be applied in any repeating pattern of discrete adhesive sections within the longitudinal edges 42.

The adhesive longitudinal strips 40 are applied in an automated process prior to pleating the layers to form the pleated filter body 12. After the adhesive strips have been applied, the layers are pleated by forming parallel fold lines 26 longitudinally along the layers. These pleats will extend transversely across the filter body 12, as illustrated in FIG. 1. The pleats are formed so that the adhesive strips 40 are disposed along the pleats. Referring to FIG. 2, it may be desired that the longitudinal strips 40 have a width so as to extend between parallel fold lines 26. In other words, the adhesive strips 40 extend across the panels 28 between the fold lines 26. It may further be desired that the longitudinal strips 40 have an overall width so as to extend beyond at least one of the fold lines 26, as illustrated in FIG. 2. The longitudinal strips 40 may have a width so as to extend beyond the fold line 26 a distance about equal to the overlap width of the pleats, as can be seen in FIG. 2. FIG. 2 also illustrates an adhesive longitudinal strip 40 defined between the parallel fold lines 26 that define the center panel 30 of the face mask 10.

It has been found that application of the adhesive in the longitudinal strips according to the invention provides a desirable degree of reliable attachment of the inner face cover layer 36 to the intermediate filter layer 38 while still allowing adequate filtration and low air resistance between the face masks layers. By applying the longitudinal strips 40 in the areas of the subsequently formed pleats, the adhesive is prevented from bleeding through the face masks layers onto the automated processing machinery. Due to the increased surface area coverage provided by applying the adhesive along the longitudinal strips as compared to relatively small discrete bonded areas, the adhesive can be lightly applied so as not to impact the overall air resistance and filtering efficiency of the mask. The amount of adhesive applied will depend on various factors, including the width of the longitudinal strips, type of adhesive, application process, etc, and an be easily determined through routine experimentation.

The invention also includes a method for forming an improved multi-layer face mask, wherein the face mask has an outer cover layer, an intermediate layer, and an inner face layer. The method includes applying an adhesive between the intermediate layer and the face layer along at least one longitudinal strip that will extend between opposite sides of the face mask body. After the adhesive has been applied, at least one pleat is folded into the layers along the longitudinal adhesive strip such that the adhesive strip extends at least between the parallel fold lines of the pleat. The adhesive strip may be applied in any conventional process, including a coating process, a meltblown spray process, a swirl spray process, etc. The method may include applying a plurality of the adhesive strips across the layers and folding a pleat into the layers for each adhesive strip. The adhesive strips may be applied in a continuous process along the adhesive strip, such as a swirl spray process, a continuous coating process, or a continuous meltblow spray process. Alternatively, the adhesive strip may be applied in a discontinuous manner along the strip, such as in a pattern of discrete areas of bonded adhesive sections.

It should be appreciated by those skilled in the art that various modifications and variations can be made in the invention without departing from the scope or spirit of the invention. For example, the invention encompasses any style of multi-layer face mask, and is not limited to any particular pleat configuration, materials, etc. It is intended that the present invention include such modifications and variations.

What is claimed is:

1. A multi-layer face mask, said face mask comprising:

a filter body having an outer cover layer, an inner face cover layer, and at least one intermediate layer; said filter body including at least one pleat formed therein extending across said filter body; and an adhesive applied between said intermediate layer and said face cover layer along at least one defined longitudinal strip extending across said filter body, said adhesive strip bordered on each longitudinal side thereof by longitudinally extending regions that are free of adhesive.

2. The face mask as in claim 1, wherein said adhesive strip is disposed along said pleat.

3. The face mask as in claim 2, wherein said pleat is defined by two generally parallel fold lines, said adhesive strip disposed between said fold lines.

4. The face mask as in claim 3, wherein said adhesive strip extends beyond each said fold line a distance about equal to an overlap width of said pleat.

5. The face mask as in claim 1, further comprising a plurality of said adhesive strips disposed between adhesive free longitudinal regions.

6. The face mask as in claim 1, wherein said adhesive strip is one of a coated or sprayed layer.

7. The face mask as in claim 1, further comprising a plurality of said pleats and at lest one said adhesive strip disposed along each said pleat.

8. The face mask as in claim 1, wherein said adhesive is applied continuously along said adhesive strip.

9. The face mask as in claim 1, wherein said adhesive is applied discontinuously along said adhesive strip.

10. A multi-layer face mask, said face mask comprising:

a filter body having an outer cover layer, an inner face cover layer, and at least one intermediate layer; said filter body including at least one pleat formed therein extending across said filter body;

an adhesive applied between said intermediate layer and said face cover layer along at least one defined longitudinal strip extending across said filter body, said adhesive strip bordered on each longitudinal side thereof by longitudinally extending regions that are free of adhesive; and wherein said filter body comprises side edges extending between top and bottom edges, said adhesive strip extending across said filter body between said side edges.

11. A multi-layer face mask, said face mask comprising:

a filter body having top and bottom edges, and side edges extending between said top and bottom edges, said filter body having an outer cover layer, an inner face layer, and at least one intermediate layer;

a plurality of pleats formed in said filter body extending between said side edges, each said pleat formed by parallel fold lines such that a width between said fold lines defines an overlap width of said pleats; and an adhesive applied between said intermediate layer and said face layer along at least one of said pleats, said adhesive applied continuously along a longitudinally extending section having a width so as to extend at least between said fold lines of said pleat.

12. The face mask as in claim 11, wherein said adhesive section extends beyond said fold lines a distance equal to about said overlap width of said pleats.

13. The face mask as in claim 11, wherein a said adhesive section is provided for each said pleat.

14. The face mask as in claim 11, wherein said adhesive section is one of a coated layer, meltblown spray layer, and swirl spray layer.

15. The face mask as in claim 11, wherein said adhesive section is bounded along its longitudinal edges by longitudinally extending adhesive free regions of said layers.

16. A method for forming a multi-layer face mask wherein the face mask has an outer cover layer, an intermediate layer, and a face layer, said method comprising applying adhesive between the intermediate layer and the face layer along at least one longitudinal strip that extends from side to side of the face mask, and subsequently folding a pleat into the layers along the adhesive strip such that the adhesive strip extends at least between parallel fold lines of the pleat.

17. The method as in claim 16, comprising applying the adhesive strip in one of a coating process, meltblown spray process, and swirl spray process.

18. The method as in claim 16, further comprising applying a plurality of the adhesive strips across the layers and folding a pleat into the layers for each adhesive strip.

19. The method as in claim 16, comprising applying the adhesive strip in a continuous manner along the adhesive strip.

20. The method as in claim 16, comprising applying the adhesive strip in a discontinuous manner along the adhesive strip.

21. The method as in claim 16, comprising applying the adhesive strip and folding the pleat in sequential steps.

* * * * *